US012735163B1

(12) United States Patent
Surma

(10) Patent No.: US 12,735,163 B1
(45) Date of Patent: Sep. 15, 2026

(54) ELECTRIC MARINE PROPULSION SYSTEMS AND METHODS OF CONTROL

(71) Applicant: Brunswick Corporation, Mettawa, IL (US)

(72) Inventor: Eric T. Surma, Ormond Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 287 days.

(21) Appl. No.: 18/763,344

(22) Filed: Jul. 3, 2024

(51) Int. Cl.
*B63H 21/21* (2006.01)

(52) U.S. Cl.
CPC ..... *B63H 21/213* (2013.01); *B63H 2021/216* (2013.01)

(58) Field of Classification Search
CPC ..... B63H 21/213; B63H 2021/216; B63H 21/17; B63H 21/21
See application file for complete search history.

(56) References Cited

U.S. PATENT DOCUMENTS

| | | | | |
|---|---|---|---|---|
| 6,273,771 | B1 | 8/2001 | Buckley | |
| 10,048,690 | B1 | 8/2018 | Hilbert | |
| 10,926,855 | B2 | 2/2021 | Derginer | |
| 11,198,494 | B2 * | 12/2021 | Derginer | B63H 20/12 |
| 11,904,996 | B2 * | 2/2024 | Derginer | B63H 20/12 |
| 2022/0194542 | A1 | 6/2022 | Kirchhoff | |
| 2023/0219675 | A1 | 7/2023 | Janeczko | |

* cited by examiner

*Primary Examiner* — Anthony D Wiest
(74) *Attorney, Agent, or Firm* — Andrus Intellectual Property Law, LLP

(57) ABSTRACT

An electric marine propulsion system for a marine vessel is provided. The system includes an electric motor configured to rotate a propulsor to propel the marine vessel and one or more controllers. The one or more controllers are configured to receive a propulsion demand and determine at least one of a maximum propulsion output, a maximum output period, a minimum propulsion output, and a minimum output period based on the propulsion demand. The one or more controllers are further configured to operate the electric motor by oscillating between the maximum propulsion output for the maximum output period and the minimum propulsion output for the minimum output period to generate an average thrust that is based on the propulsion demand.

20 Claims, 6 Drawing Sheets

ELECTRIC MARINE PROPULSION SYSTEMS AND METHODS OF CONTROL

FIELD

The present disclosure generally relates to propulsion systems for marine vessels, and more particularly to electric marine propulsion systems having electric motors and methods for controlling the same.

BACKGROUND

The following U.S. Patents and Patent Applications provide background information and are incorporated herein by reference, in entirety.

U.S. Pat. No. 6,273,771 discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 10,048,690 discloses a method of controlling two or more propulsion devices on a marine vessel includes receiving a vessel speed, determining that the vessel speed is below a first vessel speed threshold, receiving an operator thrust demand, and determining that the operator thrust demand is below a first demand threshold. At least one of the two or more propulsion devices is then turned off, and a thrust output of at least one remaining propulsion device is adjusted based on the operator thrust demand.

U.S. Pat. No. 10,926,855 discloses a method for controlling low-speed propulsion of a marine vessel powered by a marine propulsion system having a plurality of propulsion devices includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

U.S. Patent Publication No. 2022/0194542 discloses a method of controlling an electric marine propulsion system configured to propel a marine vessel including measuring at least one parameter of an electric motor in the electric marine propulsion system and determining that the parameter measurement indicates an abnormality in the electric marine propulsion system. A reduced operation limit is then determined based on the at least one parameter measurement, wherein the reduced operation limit includes at least one of a torque limit, an RPM limit, a current limit, and a power limit. The electric motor is then controlled such that the reduced operation limit is not exceeded.

U.S. Patent Publication No. 2023/0219675 discloses a method of controlling an electric marine propulsion system to propel a marine vessel includes receiving a user-set time, determining a time remaining based on the user-set time, and identifying a battery charge level of a power storage system on the marine vessel. A required battery power is then determined based on the time remaining and the battery charge level, and then an output limit is determined based on the required battery power to enable propelling the marine vessel for the user-set time without recharging the power storage system. The propulsion system is automatically controlled so as not to exceed the output limit.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one implementation of the present disclosure, an electric marine propulsion system for a marine vessel is provided. The system includes an electric motor configured to rotate a propulsor to propel the marine vessel and one or more controllers. The one or more controllers are configured to receive a propulsion demand and determine at least one of a maximum propulsion output, a maximum output period, a minimum propulsion output, and a minimum output period based on the propulsion demand. The one or more controllers further configured to operate the electric motor by oscillating between the maximum propulsion output for the maximum output period and the minimum propulsion output for the minimum output period to generate an average thrust. In some implementations, the average thrust is based on the propulsion demand.

According to another implementation of the present disclosure, a method of controlling an electric marine propulsion system for a marine vessel having an electric motor configured to rotate a propulsor to propel the marine vessel is provided. The method includes receiving a propulsion demand, and determining at least one of a maximum propulsion output, a maximum output period, a minimum propulsion output, and a minimum, output period based on the propulsion demand. The method further includes operating the electric motor by oscillating between the maximum propulsion output for the maximum output period and the minimum propulsion output for the minimum output period to generate an average thrust. In some implementations, the average thrust is based on the propulsion demand.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

During precision operations such as docking, landing, launching, and trailering of a marine vessel, low vessel speeds are desirable to ensure the operations are successfully and safely completed. However, operation of marine drive propulsors at low rotational speeds results in unpredictable steering of the drives if a minimum water velocity over the propulsor is not maintained. The need to maintain a minimum water velocity over the propulsor is particularly acute in marine vessels with rudders, such as surf boats.

The present inventor has recognized that by commanding output of marine drives that oscillates between maximum and minimum values, a minimum water velocity can be maintained over the propulsor, while a low average thrust for low speed operation is simultaneously achieved. Such oscillating, or pulsing, operation is difficult or impossible to achieve using internal combustion engines, due to the lag between the command and the achievement of a propulsion output. However, electric marine drives do not experience such lags. Accordingly, the systems and methods of the present disclosure are configured to determine when vessel conditions warrant operation of the electric marine drives in a pulsing mode to achieve low vessel speeds, for example, when an operator input to a throttle or joystick commands a speed below or certain threshold, or when an autonomous navigation system generates low speed propulsion demands. When such conditions are present, the system automatically commands propulsion outputs that oscillate between minimum and maximum values.

Figure 1:
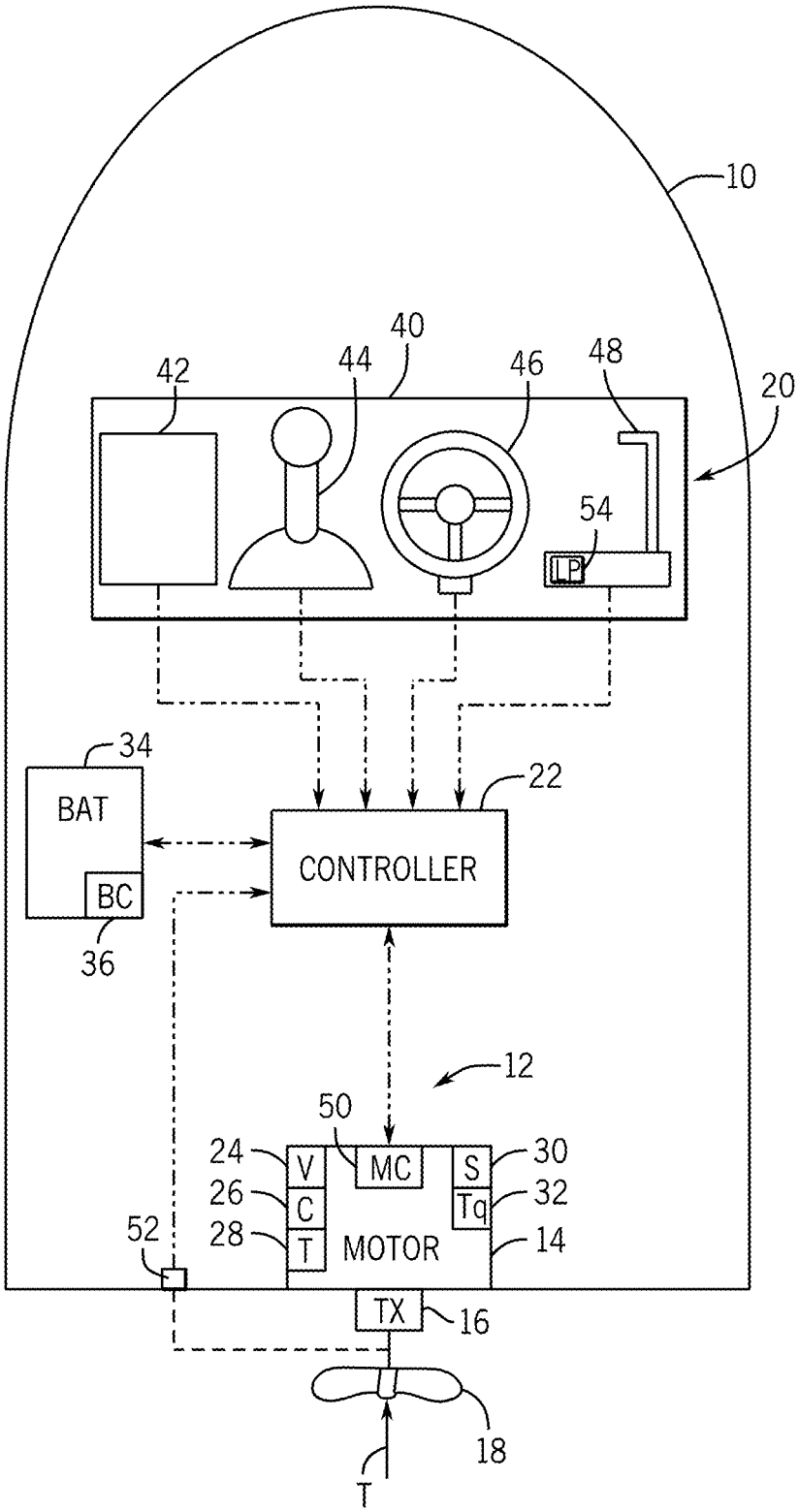
FIG. 1 is a schematic top view representation of an exemplary marine vessel configured to operate in a propulsion pulsing control mode according to the present disclosure.

FIG. 1 depicts an exemplary embodiment of a marine vessel 10 having an electric marine propulsion system 12 configured to propel the marine vessel 10 in a direction instructed by an operator using a user interface system 20, or by a guidance system configured to automatically control steering of the marine vessel 10 to steer the vessel toward a predetermined location or global position. The electric marine propulsion system 12 includes at least one electric motor 14 configured to propel the marine vessel 10 by rotating a propeller 18. The motor 14 may be, for example, a brushless electric motor, such as a brushless DC motor. In other embodiments, the electric motor 14 may be a DC brushed motor, an AC brushless motor, a direct drive, a permanent magnet synchronous motor, an induction motor, or any other device that converts electric power to rotational motion. In certain embodiments, the electric motor 14 includes a rotor and a stator, as is well known in the relevant art.

The motor 14 is powered by a power storage system or battery 34. The battery 34 stores energy for powering the electric motor 14 and is rechargeable, such as by connection to shore power when the electric motor 14 is not in use. Various power storage devices and systems are known in the relevant art. The battery 34 may be a battery system configured to output DC power including one or more banks of batteries. In other embodiments, the power storage device 34 may include one or more fuel cells, flow batteries, ultracapacitors, and/or other devices capable of storing an outputting electric energy. In further embodiments, an inverter configured to output AC power from a DC power input is associated with or otherwise a component of the power storage system 34.

The power storage device 34 may further include a battery controller 36 configured to monitor and/or control aspects of the power storage device 34. For example, the battery controller 36 may receive inputs from one or more sensors within the power storage system 34, such as a temperature sensor configured to sense a temperature within a housing of the power storage system 34 where one or more batteries or other storage elements are located. The battery controller 36 may further be configured to receive information from current, voltage, and/or other sensors within the power storage system 34, such as to receive information about the voltage, current, and temperature of each battery cell within the power storage device 34. In addition to the temperature of the power storage system 34, the battery controller 36 may be configured to calculate a charge level of the power storage system 34. The battery charge level may refer to a state of charge value, or some other value representing the amount of energy currently available from the power storage device 34.

The electric motor 14 is operably connected to the propeller 18 and configured to rotate the propeller 18. As will be known to the ordinary skilled person in the relevant art, the propeller 18 may include one or more propellers, impellers, or other propulsor devices and that the term "propeller" may be used to refer to all such devices. In certain embodiments, such as that represented in FIG. 1, the electric motor 14 may be connected and configured to rotate the propeller 18 through a gear system or transmission 16. In such an embodiment, the gear system 16 translates rotation of a motor output shaft to a propeller shaft to adjust conversion of the rotation and/or to disconnect the propeller shaft from the drive shaft, as is sometimes referred to in the art as a "neutral" position where rotation of the drive shaft is not translated to the propeller shaft. Various gear systems or transmissions 16 are well known in the relevant art. In other embodiments, the electric motor 14 may directly connect to the propeller shaft such that rotation of the drive shaft is directly transmitted to the propeller shaft at a constant and fixed ratio.

Each electric motor 14 may be associated with a motor controller 50 that is configured to control power to the electric motor 14, such as to the stator winding thereof. The motor controller 50 is configured to control the function and output of the electric motor 14, such as controlling the torque outputted by the motor, the rotational speed of the motor 14, as well as the input current, voltage, and power supplied to and utilized by the motor 14. In one arrangement, the motor controller 50 controls the current delivered to the stator windings via leads which input electrical energy to the electric motor to induce and control rotation of the rotor.

Sensors may be configured to sense the power, including the current and voltage delivered to the motor 14. For example, a voltage sensor 24 may be configured to sense the input voltage to the motor 14 and a current sensor 26 may be configured to measure input current to the motor 14. Accordingly, power delivered to the motor 14 can be calculated and such value can be used for monitoring and controlling the electric propulsion system 12, including for monitoring and controlling the motor 14. In the depicted example, the voltage and current sensors 24, 26 may communicatively connected to the motor controller 50 in order to provide measurement of the voltage and current supplied to the motor 14. The motor controller 50 is configured to provide appropriate current and/or voltage to meet the demand for controlling the motor 14. For example, a demand input may be received at the motor controller 50 from the central controller 22, such as based on an operator command at a helm input device, such as a throttle lever 48. In certain embodiments, the motor controller 50, voltage sensor 24, and current sensor 26 may be integrated into a housing of the electric motor 14, although in other embodiments the motor controller 50 may be separately housed.

Various other sensors may be configured to measure and report parameters of the electric motor 14. For example, the electric motor 14 may include means for measuring and determining the torque, rotation speed (motor speed), temperature, vibration, or any other parameter. In the depicted example, the electric motor 14 includes a temperature sensor 28 to sense a temperature of the motor 14, a speed sensor 30 configured to measure a rotational speed of the motor 14, and a torque sensor 32 for measuring the torque output of the motor 14. A propeller speed sensor 52 may be configured to measure a rotational speed of the propeller 10. For example, the propeller speed sensor 52 and/or the motor speed sensor 30 may be a Hall Effect sensor or other rotation sensor that utilizes capacitive or inductive measuring techniques. In various implementations, one or more of the parameters, such as the speed, torque, or power, may be calculated based on other measured parameters or characteristics. For example, the torque exerted by the motor 14 may be calculated based on power characteristics in relation to the rotation speed of the electric motor 14, for example. In addition, the speed of the marine vessel 10 is directly proportional to the speed of the propeller 18 as measured by the propeller speed sensor 52, and therefore the speed of the marine vessel 10 may be calculated based on measurements obtained by the propeller speed sensor 52.

Each controller (i.e., a central controller 22, the battery controller 36, and the motor controller 50) in the control system may comprise a processor and a storage device, or memory, configured to store software and/or data utilized for controlling and/or tracking operation of the electric propulsion system 12. The memory may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output system (I/O) system provides communication between the control system including the central controller 22 and peripheral devices.

The central controller 22, which in the embodiment shown in FIG. 1 may be a propulsion control module (PCM), communicates with the battery controller 36 and the motor controller 50 via a communication link such as a CAN bus as described in U.S. Pat. No. 6,273,771, incorporated by reference herein. The controller 22 also receives input from and/or communicates with one or more user interfaces in a user interface system 20 via the communication link, which in some implementations may be the same communication link as utilized for communication between the motor controller 50, battery controller 36, and central controller 22.

The user interface devices can include a display 42, a joystick 44, a steering wheel 46, and a throttle/shift lever 48. In various embodiments, the display 42 may be, for example, part of an onboard management system, such as the VesselView™ by Mercury Marine of Fond du Lac, Wisconsin. The joystick 44 and the steering wheel 46 may communicate with the central controller 22 to effectuate steering control over the propulsion system 12. For example, the joystick 44 may be utilized to provide lateral and rotational steering inputs to the propulsion system 12 during docking maneuvers. The throttle/shift lever 48 is provided to permit an operator to input thrust commands, including both a magnitude and a direction of thrust. A lever position sensor 54 may be placed anywhere on the throttle/shift lever 48 in order to sense the position of the lever 48. In the depicted embodiment, the position sensor 54 is connected to the control lever 48 such that rotation of the lever 48 causes equal rotation of the position sensor 54 such that the position and the rate of change of position of the lever 48 can be determined by the position sensor 54. The position sensor 54 may be any angular position sensor and may provide an analog output or a digital output of position to the central controller 22. For example, the position sensor 54 may be a programmable magnetic encoder, a clinometer, a Hall Effect sensor, a potentiometer, a rotary encoder, or the like.

Figure 2:
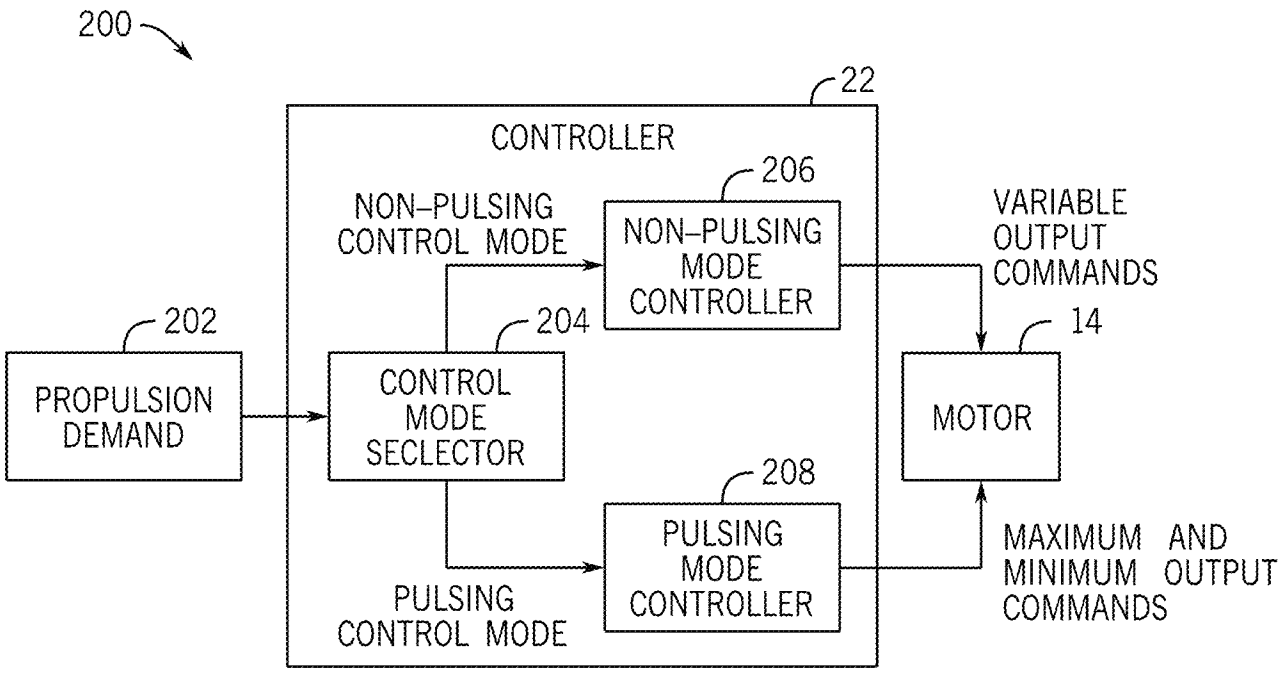
FIG. 2 is a block diagram depicting a control routine executed by a central controller to implement the propulsion pulsing control mode.

The block diagram of FIG. 2 illustrates an exemplary control routine 200 executed by the controller 22 for controlling the propulsion system 12 including the electric motor 14. At block 202, the operator generates a demand, for example, by rotating the throttle lever 48 of the user interface system 20 in a forward direction away from a neutral or detent position. The demand input signal (e.g., a lever position signal from the lever position sensor 54) is received at a control mode selector 204 within the central controller 22. Based on the amount of the operator demand (i.e., how far the operator rotates the throttle lever 48 away from the neutral or detent position as indicated by the lever position sensor 54), the control mode selector 204 may determine whether the propulsion system 12 should be operated in a non-pulsing or pulsing control mode.

For example, if the operator demand signal 202 received by the control mode selector 204 indicates an operator demand that is greater than a predetermined thrust threshold and, the central controller 22 will command the electric motor 14 to operate in the non-pulsing control mode using the non-pulsing controller 206. For example, the non-pulsing mode controller 206 may utilize a lookup table stored in a memory of the controller 206 that corresponds the operator demand signal 202 to a target speed that is representative of the speed of the motor 14 and/or a speed of the propeller 18, which is generally proportional to the speed of the marine vessel 10. Based on the target speed, the non-pulsing mode controller 206 will output a variable output command to the motor 14 to reach the target speed.

If, however, the operator demand signal 202 received by the control mode selector 204 indicates an operator demand that is less than a predetermined thrust threshold and, the central controller 22 will command the electric motor 14 to operate in the pulsing control mode using the pulsing controller 208. For example, as described in further detail below with reference to FIGS. 3-7, the pulsing controller may utilize a lookup table stored in a memory of the controller 208 that corresponds the operator demand signal to maximum and minimum propulsion commands that result in an average thrust that is below the thrust generated by the maximum propulsion output value and greater than the thrust generated by the minimum propulsion output value.

Figure 3:
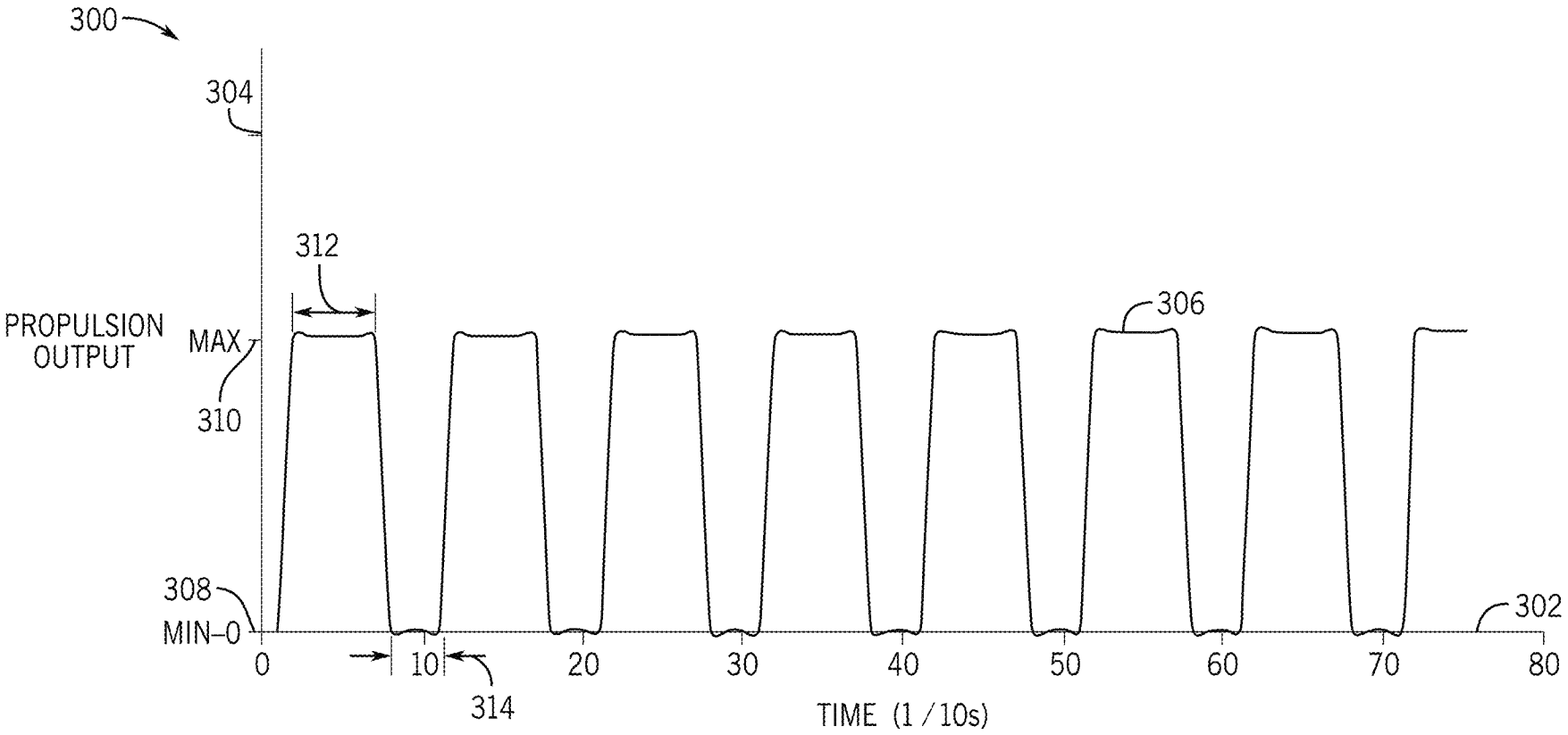
FIGS. 3-5 are exemplary plots depicting maximum and minimum propulsion outputs commanded by the central controller when operating in the propulsion pulsing control mode.
Figure 4:
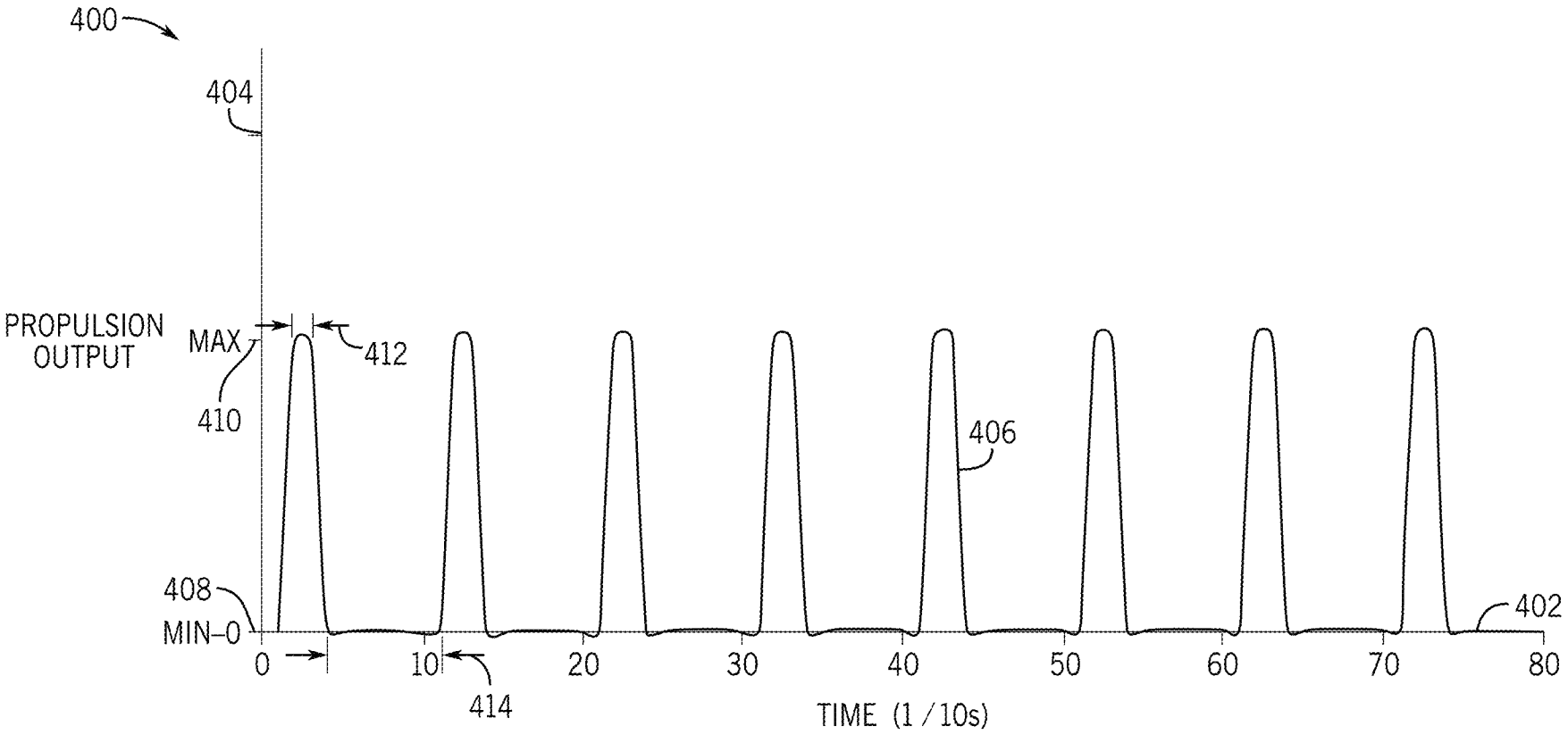
Figure 5:
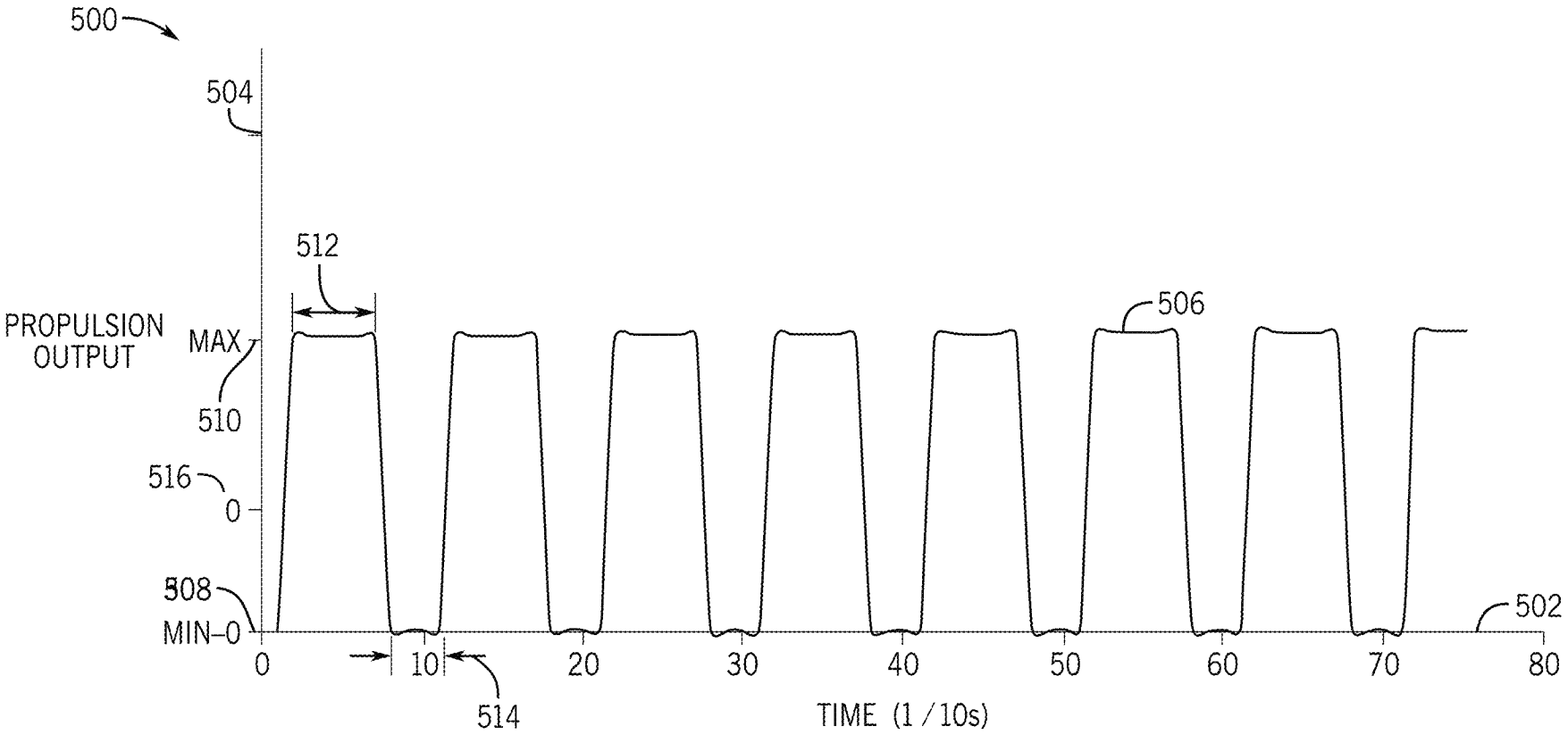

Referring now to FIG. 3-5, exemplary plots 300, 400, and 500 illustrating propulsion output oscillations that may be commanded by the controller 22 when operating in the pulsing control mode are shown. Plot 300 is shown to include a horizontal axis 302 indicating time in tenths of seconds and a vertical axis 304 indicating propulsion output. As described above, in various embodiments, the propulsion output could be a motor speed, a motor torque, or a motor current. Line 306 depicts the commanded propulsion output as it oscillates between a minimum propulsion output value of zero at 308 and a maximum propulsion output value at 310. The controller 22 may command the maximum propulsion output value 310 for a maximum output period 312, and the minimum propulsion output value 308 for a minimum output period 314. In this way, the controller 22 achieves an average thrust generated by the propulsion system 12 that is less than the thrust generated by the maximum propulsion output 310 and greater than the thrust generated by the minimum propulsion output 308.

Modifications of the maximum propulsion output, minimum propulsion output, maximum output period, and minimum output period can be utilized to modify the average thrust generated by the propulsion system 12. For example, similar to FIG. 3, plot 400 of FIG. 4 is shown to include a horizontal axis 402 indicating time in tenths of seconds on a vertical axis 404 indicating propulsion output. Line 406 depicts the commanded propulsion output as it oscillates between a minimum propulsion output of zero at 408 and a maximum propulsion output value at 410. The controller may command the maximum propulsion output value 408 for a maximum output period 412 and a minimum propulsion output value 408 for a minimum output period 414. Since the duty cycle of the propulsion output as represented by maximum propulsion output period 412 is shorter than the maximum propulsion output period 312 depicted in FIG. 3, the propulsion pulsing mode depicted in FIG. 4 will result in a smaller average thrust than the propulsion pulsing mode depicted in FIG. 3, presuming that the maximum propulsion output 310 is equal to the maximum propulsion output 410. In an exemplary embodiment, the maximum propulsion output period 412 will always be greater than or equal to a maximum propulsion output period threshold, which may be dependent on various characteristics of the marine vessel, for example, the pitch of the propeller blades included in the propulsor 18 or a distance between a rudder of the marine vessel 10 and the motor 14.

Line 506 of FIG. 5 is representative of propulsion output oscillations that may be commanded by the controller 22 between a maximum propulsion output 510 for a maximum output period 512 that is representative of rotation of the propulsor 18 in a first direction corresponding to forward thrust generated by the propulsion system 12, and a minimum propulsion output 508 that is less than a zero propulsion output 516 and is thereby representative of rotation of the propulsor 18 in a second direction opposite the first direction corresponding to reverse thrust generated by the propulsion system 12. In this way, the controller 22 may achieve a smaller average thrust than the propulsion pulsing mode depicted in FIG. 3, without reducing the duty cycle as depicted in FIG. 4.

Figure 6:
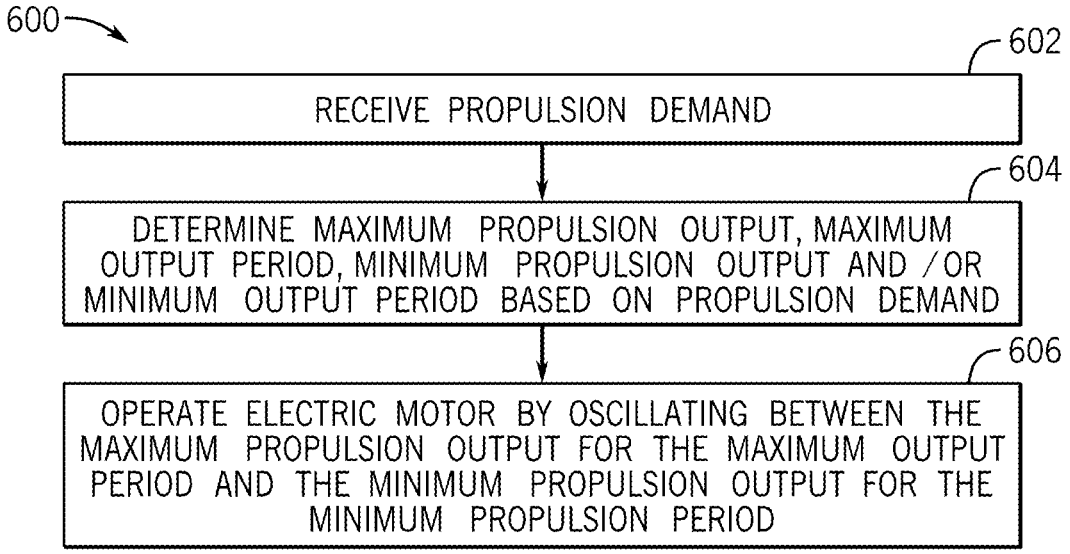
FIGS. 6 and 7 are flowcharts depicting exemplary methods for operating the marine vessel in the propulsion pulsing control mode.

Referring now to FIG. 6, an exemplary method 600 for controlling the propulsion system 12 in a propulsion pulsing mode is provided. In an exemplary implementation, method 600 is performed substantially by the controller 22. Method 600 commences at step 602, as the controller 22 receives a propulsion demand (e.g., propulsion demand 202, see FIG. 2). In various embodiments, the propulsion demand could be generated based on a position of the throttle lever 48, for example, if the throttle lever 48 is within a low speed throttle region, or a position of the joystick 44, for example, if the joystick 44 is moved by an operator in a predetermined direction or by a predetermined amount indicative of desired low speed operation of the propulsion system 12. In still further embodiments, the propulsion demand could be an automated propulsion demand generated by an autodocking system.

At step 604, the controller 22 determines at least one of a maximum propulsion output, a maximum propulsion period, a minimum propulsion output, and a minimum propulsion period based on the propulsion output. In certain embodiments, the controller 22 may determine that the propulsion demand is less than a threshold low-speed propulsion magnitude as a precondition to performing step 604. The maximum and minimum propulsion outputs and propulsion output periods may be based on characteristics on the vessel 10 and its propulsion system 12. In some embodiments, the propulsion outputs and propulsion output periods may be selected from a lookup table stored in the pulsing mode controller 208 (see FIG. 2) based on the magnitude of the propulsion demand. Method 600 concludes at step 606, as the controller 22 operates the motor 14 per the maximum propulsion output, maximum propulsion period, minimum propulsion output, and minimum propulsion period determined in step 604 as shown in the exemplary control output plots of FIGS. 3-5.

Figure 7:
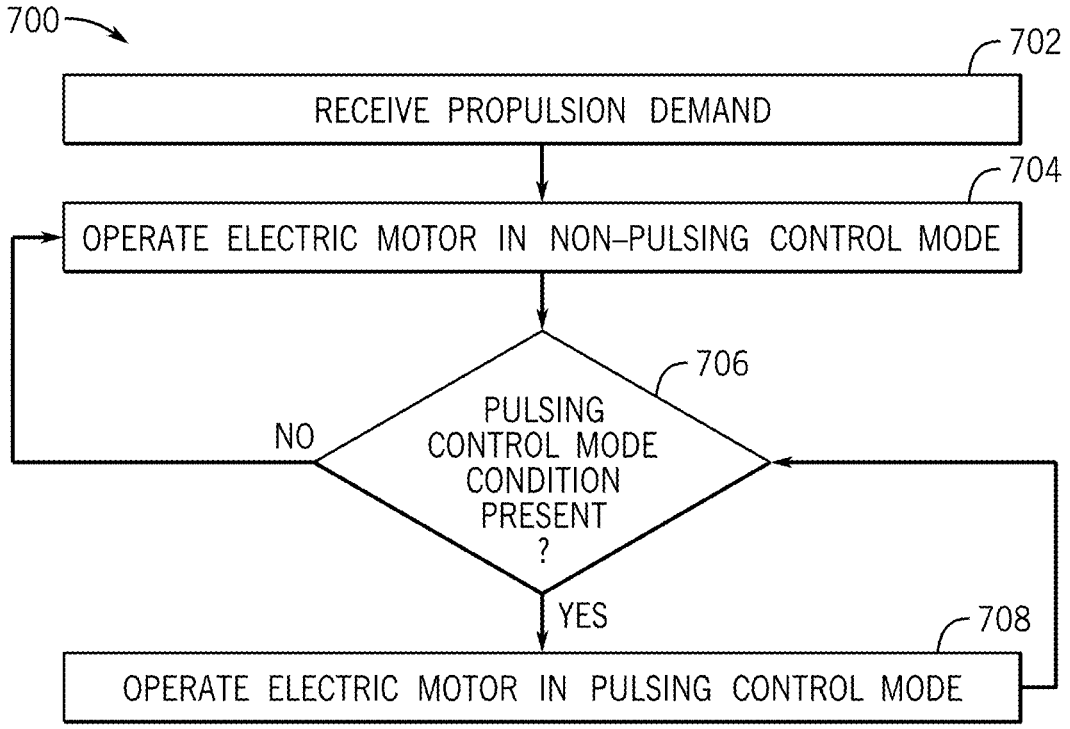

FIG. 7 depicts an exemplary method 700 for controlling the propulsion system 12 in both pulsing and non-pulsion propulsion modes. Method 700 commences at step 702, as the controller 22 receives a propulsion demand (e.g., propulsion demand 202, see FIG. 2). As described above, the propulsion demand is generated responsive to a position of a joystick 44 or throttle lever 48, or it may be generated by an autonavigation (e.g., autodocking) system. In some embodiments, the controller 22 may initially operate the propulsion system 12 in a non-pulsing control mode. In the non-pulsing control mode, the propulsion output is non-oscillatory and directly correlated to the propulsion demand. For example, the controller 22 may proportionally increase or decrease the propulsion output based on an amount of change in position of the joystick 44 or the throttle lever 48.

At step 706, the controller 22 determines whether a pulsing mode condition is present. In some embodiments, the controller 22 determines whether the pulsing mode condition is present without first operating the propulsion system 12 in the non-pulsing control mode. The pulsing mode condition may be based on the position of the joystick 44 or the throttle lever 48, for example, if an operator moves the throttle lever 48 to a position within a predetermined low speed range or if the resulting propulsion demand is below a threshold low-speed propulsion magnitude. In other embodiments, the pulsing control mode condition may be present if an autodocking system generates a propulsion demand (e.g., motor speed, motor torque, motor current) that is below a specified pulsing control mode threshold. In still further embodiments, the pulsing mode condition may be present if an operator inputs a command at the display 42 to enter the pulsing control mode.

If the pulsing mode condition is not determined to be present at step 706, method 700 reverts to step 704 and the controller 22 operates the propulsion system 12 in the non-pulsing control mode. However, if the controller 22 determines that the pulsing control mode condition is present at step 706, method 700 advances to step 708 and begins operating the propulsion system 12 in the pulsing control mode to oscillate between maximum and minimum propulsion outputs, as depicted in the examples of FIGS. 3-5. From step 708, method 700 may revert to step 706 and operate the propulsion system 12 in the pulsing control mode only so long as the pulsing control mode condition remains present. For example, if an operator moves the throttle lever 48 out of the predetermined pulsing control mode range, the controller 22 may revert to operate the propulsion system in the non-pulsing control mode.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An electric marine propulsion system for a marine vessel, comprising:

an electric motor configured to rotate a propulsor to propel the marine vessel;

one or more controllers configured to:

receive a propulsion demand;

determine at least one of a maximum propulsion output, a maximum output period, a minimum propulsion output, and a minimum output period based on the propulsion demand; and operate the electric motor by oscillating between the maximum propulsion output for the maximum output period and the minimum propulsion output for the minimum output period to generate an average thrust that is based on the propulsion demand.

2. The electric marine propulsion system of claim 1, wherein the propulsion output is one of a motor speed, a motor torque, and a motor current.

3. The electric marine propulsion system of claim 1, further comprising a throttle lever and/or a joystick, wherein the propulsion demand is based on a position of the throttle lever and/or the joystick.

4. The electric marine propulsion system of claim 1, wherein:

operating the electric motor by oscillating between the maximum propulsion output for the maximum output period and the minimum propulsion output for the minimum output period comprises operation in a pulsing control mode; and the one or more controllers are further configured to operate the electric motor in a non-pulsing control mode in which the propulsion demand directly corresponds to a variable propulsion output.

5. The electric marine propulsion system of claim 4, further comprising a throttle lever and/or a joystick, and wherein the one or more controllers are configured to transition between the non-pulsing control mode and the pulsing control mode based on a position of the throttle lever and/or the joystick.

6. The electric marine propulsion system of claim 4, wherein the one or more controllers are configured to transition between the non-pulsing control mode and the pulsing control mode based on a magnitude of the propulsion demand.

7. The electric marine propulsion system of claim 1, further comprising determining that the propulsion demand is less than a threshold low-speed propulsion magnitude as a precondition to determining the at least one of the maximum propulsion output, the maximum output period, the minimum propulsion output, and the minimum output period based on the propulsion demand.

8. The electric marine propulsion system of claim 1, wherein the minimum propulsion output comprises a zero propulsion output.

9. The electric marine propulsion system of claim 1, wherein the electric motor is configured to rotate the propulsor in a first direction and a second direction; and wherein the one or more controllers are configured to operate the electric motor in the first direction at the maximum propulsion output and in the second direction at the minimum propulsion output.

10. The electric marine propulsion system of claim 1, wherein the maximum output period is greater than or equal to a maximum output period threshold, and wherein the maximum output period threshold is based at least in part on a pitch of the propulsor.

11. A method of controlling an electric marine propulsion system for a marine vessel having an electric motor configured to rotate a propulsor to propel the marine vessel, the method comprising:

receiving a propulsion demand;

determining at least one of a maximum propulsion output, a maximum output period, a minimum propulsion output, and a minimum output period based on the propulsion demand; and operating the electric motor by oscillating between the maximum propulsion output for the maximum output period and the minimum propulsion output for the minimum output period to generate an average thrust that is based on the propulsion demand.

12. The method of claim 11, wherein the propulsion output is one of a motor speed, a motor torque, and a motor current.

13. The method of claim 11, wherein the propulsion demand is based on a position of a throttle lever and/or a joystick.

14. The method of claim 11, wherein:

operating the electric motor by oscillating between the maximum propulsion output for the maximum output period and the minimum propulsion output for the minimum output period comprises operation in a pulsing control mode; and wherein the method further comprises operating the electric motor in a non-pulsing control mode in which the propulsion demand directly corresponds to a variable propulsion output.

15. The method of claim 14, further comprising transitioning between the non-pulsing control mode and the pulsing control mode based on a position of a throttle lever and/or a joystick.

16. The method of claim 14, further comprising transitioning between the non-pulsing control mode and the pulsing control mode based on a magnitude of the propulsion demand.

17. The method of claim 11, further comprising determining that the propulsion demand is less than a threshold low-speed propulsion magnitude as a precondition to determining the at least one of the maximum propulsion output, the maximum output period, the minimum propulsion output, and the minimum output period.

18. The method of claim 11, wherein the minimum propulsion output comprises a zero propulsion output.

19. The method of claim 11, wherein the electric motor is configured to rotate the propulsor in a first direction and a second direction; and wherein the method comprises operating the electric motor in the first direction at the maximum propulsion output and in the second direction at the minimum propulsion output.

20. The method of claim 11, wherein the maximum output period is greater than or equal to a maximum output period threshold, and wherein the maximum output period threshold is based at least in part on a pitch of the propulsor.

* * * * *